US007730825B2

(12) United States Patent
Wong et al.

(10) Patent No.: US 7,730,825 B2
(45) Date of Patent: Jun. 8, 2010

(54) VEHICULAR HYDRAULIC SYSTEM WITH PRIORITY VALVE AND RELIEF VALVE

(75) Inventors: Albert C. Wong, Saginaw, MI (US); James L. Davison, Freeland, MI (US); Rick L. Lincoln, Linwood, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 307 days.

(21) Appl. No.: 11/901,821

(22) Filed: Sep. 19, 2007

(65) Prior Publication Data

US 2008/0066460 A1 Mar. 20, 2008

Related U.S. Application Data

(60) Provisional application No. 60/845,911, filed on Sep. 20, 2006.

(51) Int. Cl.
*F15B 13/06* (2006.01)

(52) U.S. Cl. ..... 91/516

(58) Field of Classification Search ..... 91/516
See application file for complete search history.

(56) References Cited

U.S. PATENT DOCUMENTS

| | | | |
|---|---|---|---|
| 3,050,944 | A | 8/1962 | Schwartz et al. |
| 3,633,363 | A | 1/1972 | Larsen |
| 3,662,548 | A | 5/1972 | Suzuki et al. |
| 3,785,393 | A | 1/1974 | Tanguy |
| 3,879,948 | A | 4/1975 | Flory |
| 3,915,186 | A | 10/1975 | Thomas |
| 3,941,142 | A | 3/1976 | Adachi et al. |
| 4,070,858 | A | 1/1978 | Hand |
| 4,074,528 | A | 2/1978 | Lourigan et al. |
| 4,075,840 | A | 2/1978 | Jesswein |
| 4,139,988 | A | 2/1979 | Adachi |
| 4,161,867 | A | 7/1979 | Adachi |
| 4,174,018 | A | 11/1979 | Liebert et al. |
| 4,181,371 | A | 1/1980 | Adachi |
| 4,251,193 | A | 2/1981 | Minnis et al. |
| 4,253,382 | A | 3/1981 | Yip |
| 4,414,809 | A | 11/1983 | Burris |
| 4,420,934 | A | 12/1983 | Udono |
| 4,620,750 | A | 11/1986 | Leiber |
| 4,967,643 | A | 11/1990 | Siegel |
| 5,385,455 | A | 1/1995 | Dinsmore et al. |
| 5,471,838 | A | 12/1995 | Suzuki et al. |
| 5,535,845 | A | 7/1996 | Buschur |

(Continued)

*Primary Examiner*—F. Daniel Lopez
(74) *Attorney, Agent, or Firm*—Cantor Colburn LLP

(57) ABSTRACT

A vehicular hydraulic system having a pump, flow-splitting valve, first application and second application arranged in series. The flow-splitting valve diverts a portion of the primary fluid flow to the second application when the pressure exceeds a threshold value. A valve member disposed in the flow-splitting valve defines a pressure-reducing orifice that communicates fluid across the valve member. A one-way relief valve prevents fluid flow through the pressure-reducing orifice when the pressure in the valve is below the threshold value. When the pressure exceeds the threshold value, fluid flows through relief valve and the pressure reducing orifice resulting in the movement of the valve member and exposure of a bypass port to thereby divert a portion of the primary fluid flow to the second application. The relief valve may be selectively variable to thereby provide for the adjustment of the threshold value.

17 Claims, 2 Drawing Sheets

U.S. PATENT DOCUMENTS

| | | | | |
|---|---|---|---|---|
| 5,651,665 | A | 7/1997 | Can et al. | |
| 5,802,848 | A | 9/1998 | McClendon et al. | |
| 5,881,630 | A | 3/1999 | Buschur et al. | |
| 5,960,628 | A | 10/1999 | Machesney et al. | |
| 6,016,657 | A | 1/2000 | Buschur | |
| 6,343,469 | B1 | 2/2002 | Penninger et al. | |
| 6,814,413 | B2 * | 11/2004 | Davison et al. | 303/114.1 |
| 6,959,639 | B2 * | 11/2005 | Nagumo et al. | 91/516 |
| 7,155,907 | B2 | 1/2007 | Desjardins et al. | |

* cited by examiner

VEHICULAR HYDRAULIC SYSTEM WITH PRIORITY VALVE AND RELIEF VALVE

CROSS REFERENCE TO RELATED APPLICATIONS

This application claims priority under 35 U.S.C. 119(e) of U.S. provisional patent application Ser. No. 60/845,911 filed on Sep. 20, 2006 entitled VEHICULAR HYDRAULIC SYSTEM WITH PRIORITY VALVE AND RELIEF VALVE the disclosure of which is hereby incorporated herein by reference.

BACKGROUND OF THE INVENTION

1. Field of the Invention

The present invention relates to hydraulic systems for vehicles and, more particularly, to a hydraulic system having a hydraulic fluid pump and at least two hydraulic applications.

2. Description of the Related Art

Many trucks with hydraulic braking systems, particularly larger gasoline powered and diesel powered trucks, incorporate hydraulic braking assist systems, rather than vacuum assist systems commonly found in passenger automobiles. The use of vacuum assist braking systems can be problematic in vehicles having a turbo-charged engine and such vehicles will also often employ hydraulic braking assist systems. Furthermore, there is an aftermarket demand for hydraulic braking assist systems for vehicles, such as hotrods, that may not otherwise have a brake assist device or for which the use of a vacuum assist system presents difficulties. Such hydraulic braking assist systems are well known and sold commercially.

Typically, these hydraulic braking assist systems are connected in series between the steering gear and hydraulic pump and use flow from the pump to generate the necessary pressure to provide brake assist as needed. The flow from the pump is generally confined within a narrow range of flow rates and is not intentionally varied to meet changing vehicle operating conditions. Because of the series arrangement, the application of the brakes and engagement of the hydraulic braking assist system can affect the flow of hydraulic fluid to the steering gear, thereby affecting the amount of assist available to the steering gear. Specifically, when a heavy braking load is applied, it causes an increase in backpressure to the pump which can exceed a threshold relief pressure (e.g., 1,500 psi) of the pump. Above this level, a bypass valve of the pump opens to divert a fraction of the outflow back to the intake of the pump, where the cycle continues until the pressure from the brake assist device drops below the threshold value of the bypass valve. During this relief condition, a diminished flow of fluid is sent to the steering gear which may result in a detectable increase in steering effort by the operator of the vehicle to turn the steering wheel under extreme relief conditions.

To at least partially alleviate this condition, it is possible to place a flow-splitter or priority valve in the hydraulic system to divert a portion of the flow of fluid being discharged from the pump to the steering gear under heavy braking conditions. The disclosure of U.S. Pat. No. 6,814,413 B2 describes the use of such a flow-splitter and is hereby incorporated herein by reference. Although the flow-splitters disclosed in U.S. Pat. No. 6,814,413 B2 are effective, they are relatively complex to manufacture and, thus, relatively expensive. A simplified valve structure for use in such a hydraulic system having both a brake assist device and a steering assist device arranged in series is desirable.

SUMMARY OF THE INVENTION

The present invention provides a priority or flow-splitting valve and a relief valve arrangement that can be used in a hydraulic system having two hydraulic applications wherein the priority valve and relief valve arrangement diverts a portion of the fluid flow from the hydraulic pump past the first application to the second application when the first application is generating a high backpressure.

The invention comprises, in one form thereof, a vehicular hydraulic system with a hydraulic circuit having, arranged in series and in serial order along a primary flow path, a hydraulic pump, a first hydraulic application, and a second hydraulic application. The hydraulic circuit also includes a flow-splitting valve having a valve body and a valve member. The valve body defines a valve chamber having an axis wherein the valve member is axially slidable within the chamber between a first axial position and a second axial position and partitions the chamber into a primary flow channel and a secondary volume. The valve member also defines a pressure-reducing orifice providing fluid communication between the primary flow channel and the secondary volume. The valve body defines an inlet port in fluid communication with the primary flow channel, an outlet port in fluid communication with the primary flow channel, a secondary volume port in fluid communication with the secondary volume, and a bypass port. The bypass port is disposed at an axially intermediate position with the secondary volume port being disposed on one axial side of the bypass port and the inlet port and the outlet port being disposed on the opposing axial side of the bypass port. The bypass port is sealed from fluid communication with the valve chamber when the valve member is in the first axial position and the bypass port is in fluid communication with the primary flow channel when the valve member is in the second axial position. The flow-splitting valve is operably disposed in the hydraulic circuit downstream of the pump and upstream of the first hydraulic application wherein the primary flow path extends from the hydraulic pump to the inlet port, through the primary flow channel and the outlet port to the first hydraulic application. The bypass port is in fluid communication with the primary flow path at a point downstream of the first hydraulic application and upstream of the second hydraulic application. A biasing member is operably coupled with the valve member and biases the valve member toward the first position. The hydraulic circuit also includes a one-way relief valve operably disposed between the secondary volume port and the primary flow channel at a location downstream of the second hydraulic application and upstream of the pump. The relief valve allows fluid flow from the secondary volume port to the primary flow path when a pressure in the primary flow channel communicated to the secondary volume through the pressure-reducing orifice exceeds a threshold pressure value. When the relief valve permits fluid flow therethrough, fluid flowing from the primary flow channel to the secondary volume through the pressure-reducing orifice experiences a reduction in pressure thereby producing a pressure differential between the secondary volume and the primary flow channel. This pressure differential biases the valve member from the first axial position to the second axial position. When the relief valve closes and terminates fluid flow therethrough, the pressure differential decreases and the biasing member biases the valve member to the first axial position.

The invention may take the form of a variety of alternative embodiments. In some embodiments, the one-way relief valve defines a selectively variable resistance to opening of the relief valve to fluid flow therethrough whereby the threshold pressure value is adjustable. For such selectively variable relief valves, the valves may provide for the external adjustment of the relief valve to selectively vary the resistance to opening of the valve to thereby allow for the convenient adjustment of the threshold pressure value.

In other embodiments, the relief valve may be disposed in a fluid line extending from the secondary volume port to the primary flow path wherein the relief valve is spaced from the flow-splitting valve by a portion of the connecting fluid line.

In yet other embodiments, the first hydraulic application may be a hydraulic brake booster device and the second hydraulic application may be a hydraulic steering gear device.

An advantage of the present invention is that it provides a priority valve and relief valve arrangement for a hydraulic system having two hydraulic applications arranged in series wherein the priority valve has a relatively non-complex design which allows for manufacturing efficiencies.

BRIEF DESCRIPTION OF THE DRAWINGS

The above mentioned and other features of this invention, and the manner of attaining them, will become more apparent and the invention itself will be better understood by reference to the following description of an embodiment of the invention taken in conjunction with the accompanying drawings, wherein.

Figure 1:
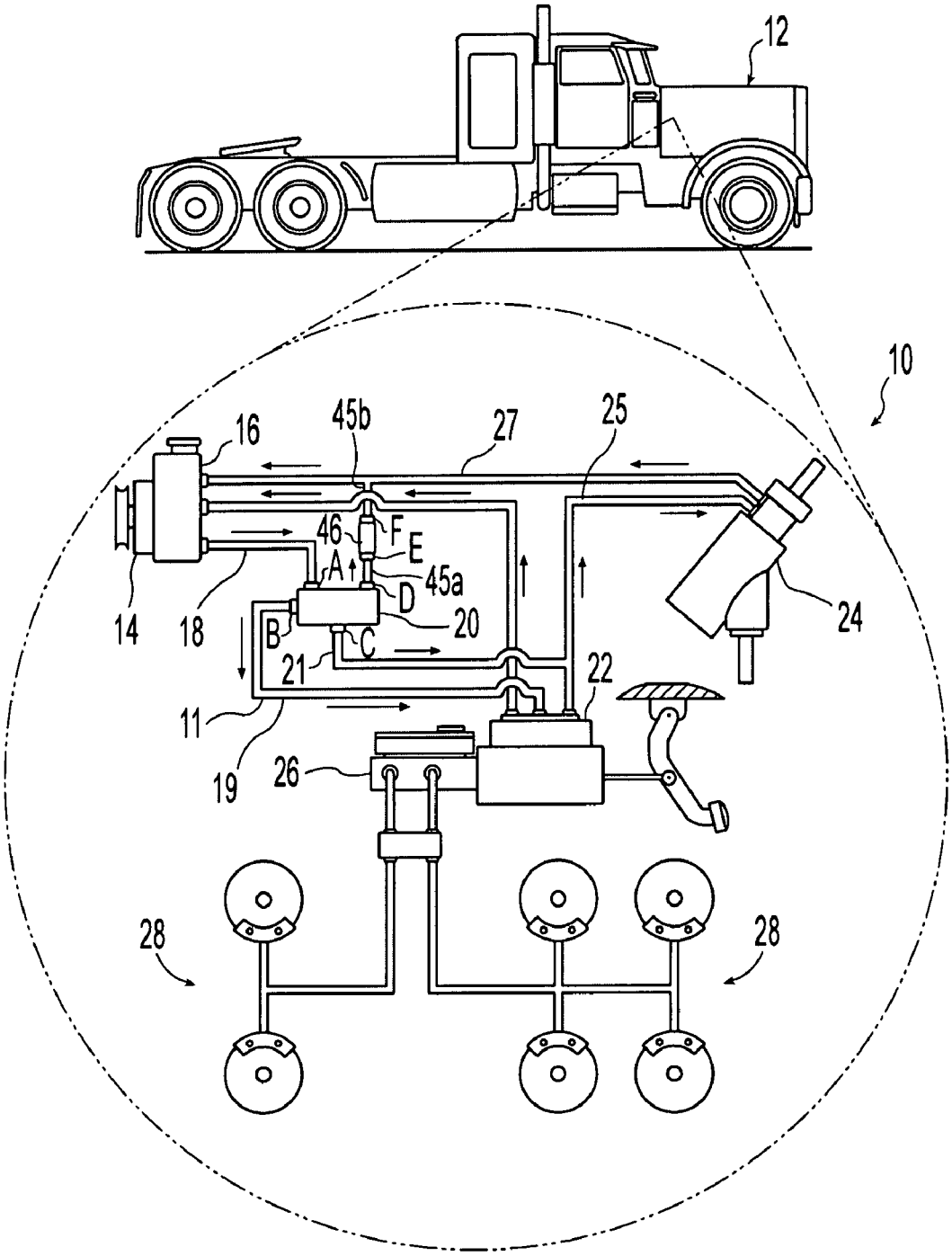
FIG. 1 is a schematic view of a hydraulic system in accordance with the invention.

Corresponding reference characters indicate corresponding parts throughout the several views. Although the exemplification set out herein illustrates an embodiment of the invention, in one form, the embodiment disclosed below is not intended to be exhaustive or to be construed as limiting the scope of the invention to the precise form disclosed.

DETAILED DESCRIPTION OF THE INVENTION

FIG. 1 shows a hydraulic system 10 for a vehicle 12 for assisting in the steering and braking of the vehicle. The hydraulic system includes a hydraulic pump 14 and reservoir 16. The reservoir may be incorporated into the pump 14, as illustrated, or may be located remote from the pump 14.

The pump 14 delivers high pressure hydraulic fluid through discharge line 18 to a flow splitting valve 20 also referred to as a priority valve. The priority valve 20, in turn, selectively communicates with a first hydraulic application 22, a second hydraulic application 24, and the reservoir 16, depending on predetermined operating conditions of the system 10, as will be explained below.

The first and second hydraulic applications 22, 24 take the form of a hydraulic device or a hydraulic sub-circuit. In the illustrated embodiment, first application 22 is a hydraulic braking assist system or booster device and the second application 24 is a hydraulic steering gear assist system or device.

The hydraulic brake booster device 22 communicates with a master cylinder 26 and brakes 28 of the braking system and further with the steering assist device 24 through line 25. In the illustrated system 10, hydraulic braking assist device 22 and hydraulic steering gear assist device 24 have relief pressures that are substantially equivalent.

The hydraulic booster device 22 is of a type well known in the art which is disposed in line between the hydraulic pump and the hydraulic master cylinder of a vehicular hydraulic brake system which acts to boost or amplify the force to the brake system in order to reduce brake pedal effort and pedal travel required to apply the brakes as compared with a manual braking system. Such systems are disclosed, for example, in U.S. Pat. Nos. 4,620,750 and 4,967,643, the disclosures of which are both incorporated herein by reference, and provide examples of a suitable booster device 22. Briefly, hydraulic fluid from the supply pump 14 is communicated to the booster device 22 through a booster inlet port and is directed through an open center spool valve slideable in a booster cavity (not shown). A power piston slides within an adjacent cylinder and is exposed to a fluid pressure on an input side of the piston and coupled to an output rod on the opposite side. An input reaction rod connected to the brake pedal extends into the housing and is linked to the spool valve via input levers or links. Movement of the input rod moves the spool valve, creating a restriction to the fluid flow and corresponding boost in pressure applied to the power piston. Steering pressure created by the steering gear assist system 24 is isolated from the boost cavity by the spool valve and does not affect braking but does create a steering assist backpressure to the pump 14. The priority valve 20 operates to manage the flow of hydraulic fluid from the pump 14 to each of the brake assist 22 and steering assist 24 systems in a manner that reduces the interdependence of the steering and braking systems on one another for operation.

Figure 2:
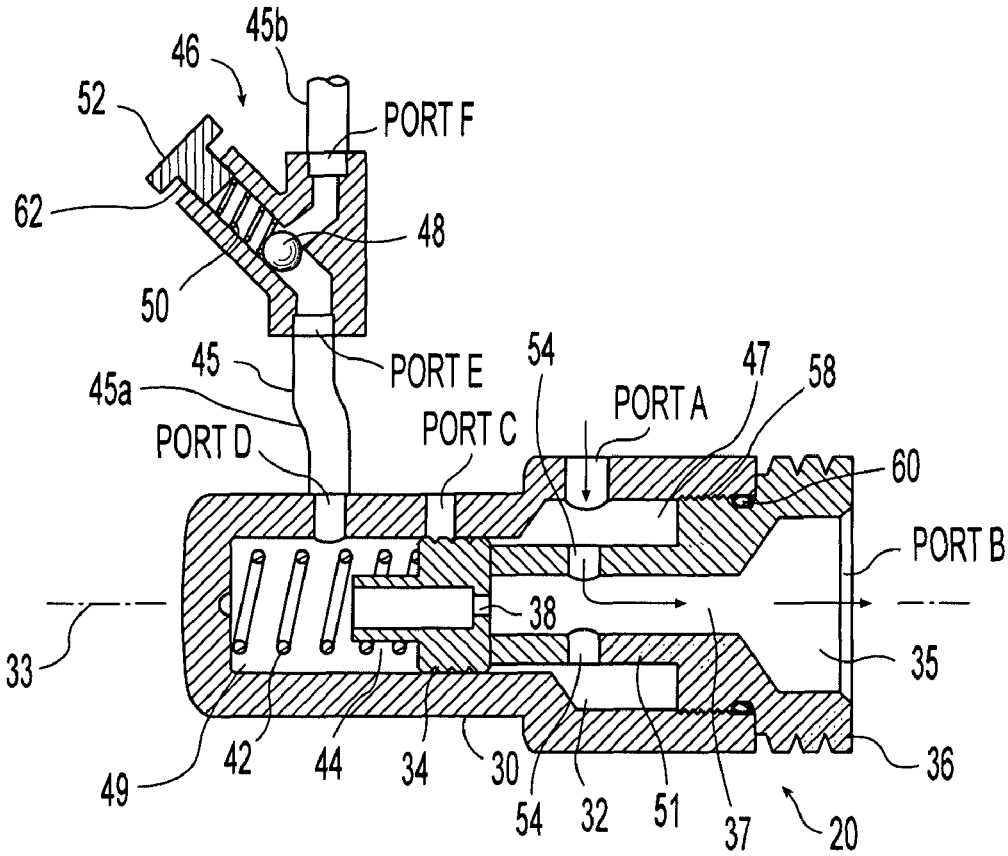
FIG. 2 is a partial cross sectional schematic view of the priority valve and relief valve under normal flow conditions.
Figure 3:
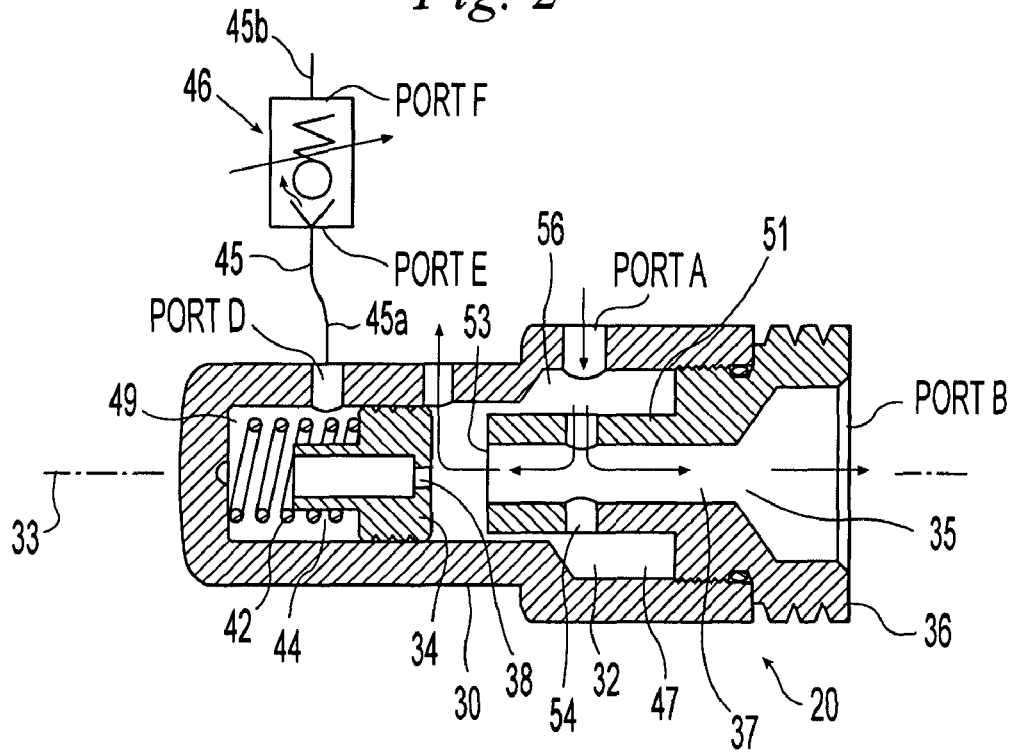
FIG. 3 is a partial cross sectional schematic view of the priority valve and relief valve of FIG. 2 where the brake assist pressure has reached a control pressure causing a diversion of flow to the steering gear assist device.

With reference to FIGS. 2 and 3, the priority valve 20 includes a valve body 30 having a bore forming valve chamber 32 in which a slideable flow control valve member 34 is accommodated. A plurality of ports are provided in the valve body 30, and are denoted in the Figures as ports A (inlet port), B (outlet port), C (bypass port) and D (secondary volume port). Fluid from the pump 14 is directed into the valve body 30 through inlet port A, where it enters the valve chamber 32 and is directed out of the body 30 through one or more of the ports B, C and D, depending upon the operating conditions which will now be described.

FIG. 2 shows normal operation of the priority valve 20 under conditions where backpressure from the brake assist device 22 and the backpressure from the steering assist device 24 are below predetermined threshold pressures. All of the flow entering port A passes through a primary flow channel 35 of valve 20 and is routed through port B to the hydraulic brake booster 22.

In the normal flow condition illustrated in FIG. 2, both the brake assist 22 and steering assist 24 are operating below the predetermined threshold or relief pressure and the fluid flows freely into port A and out port B through the primary flow channel 35. As shown, the valve body 30 may be fitted with a union fitting 36 which extends into the valve chamber 32.

Elongate valve chamber 32 has two cylindrical sections coaxially aligned along axis 33 with a first cylindrical section 47 having a larger diameter than second cylindrical section 49. In the illustrated embodiment, union fitting 36 includes threads 58 engaged with corresponding threads in large cylindrical section 47 of valve chamber 32 and an O-ring 60 to provide a seal. Union fitting 36 also includes a hollow tubular portion 51 with an open end 53 that extends into valve chamber 32. Tubular portion 51 has a smaller outer diameter than the inner diameter of cylindrical section 47 of chamber 32 whereby an interstitial space 56 is defined within valve chamber 32 between tubular portion 51 and valve body 30. Tubular portion 51 also includes sidewall openings 54 which provide fluid communication between interstitial space 56 and the interior 37 of union fitting 36. Inlet port A is in fluid communication with interstitial space 56 while outlet port B is in fluid communication with interior 37 of fitting 36. Thus, the primary flow channel 35 through valve 20 from port A to port B is defined, in the illustrated embodiment, by interstitial space 56, sidewall openings 54 and interior volume 37 of fitting 36.

Valve member 34 includes a pressure reducing orifice 38 that provides fluid communication between primary channel 35 and the secondary volume 44 of chamber 32 located rearwardly of valve member 34. In the normal flow condition illustrated in FIG. 2, secondary volume 44 is in communication with Port D and valve member 34 seals Port C from fluid communication with valve chamber 32 preventing fluid communication between Port C and both secondary volume 44 and primary channel 35.

A relief valve 46 is disposed in a hydraulic line 45 extending from secondary port D to hydraulic line 27 at a location downstream of steering gear device 24 and upstream of pump 14. Relief valve 46 is spaced from port D by a first portion 45*a* of line 45 while a second portion 45*b* of line 45 extends from valve 46 to line 27. Relief valve 46 has an inlet port, Port E, that is in fluid communication with Port D through hydraulic line portion 45*a*. Relief valve 46 also has a discharge port, Port F, that is in communication with reservoir 16 through line portion 45*b* and line 27. In the illustrated embodiment, reservoir 16 is disposed downstream of steering gear 24 and upstream of pump 14 and holds hydraulic fluid at a relatively low pressure. The fluid pressure within hydraulic reservoir 16 is communicated to discharge port F through fluid lines 27 and 45*b*. Relief valve 46 prevents the flow of fluid from Port F to Port E and allows the flow of fluid from Port E to Port F when the fluid pressure within secondary volume 44 overcomes the threshold pressure value of relief valve 46 as discussed in greater detail below.

Under normal flow conditions, relief valve 46 is closed and prevents the flow of fluid from Port E To Port F. As mentioned above, secondary volume 44 is in fluid communication with primary channel 35 through orifice 38. Consequently, when relief valve 46 is closed and priority valve 20 is in the normal flow condition, as depicted in FIG. 2, the fluid pressure in secondary volume 44 is the same as the fluid pressure in primary channel 35. Under these normal flow conditions, the biasing member 42, which takes the form of a helical spring in the illustrated embodiment, holds valve member 34 forward against the union fitting 36. In this position, the valve 34 prevents fluid entering through Port A from leaving through bypass port C to the steering assist 24 while relief valve 46 prevents the discharge of fluid through Port D to reservoir 16. Consequently, when valve 34 is in the position shown in FIG. 2, all of the fluid entering Port A is discharged through Port B and fluid neither enters nor is discharged through either of Ports C or D. Of course, for all real devices, there is some inherent loss of fluid due to clearances between individual parts.

Turning now to FIG. 3, the condition is shown where the brake assist pressure developed by the brake assist device 22 within port B and the primary channel 35 exceeds a predetermined threshold pressure value or control pressure. (The hydraulic fluid in primary channel 35 is exposed to valve member 34 through the open end 53 of union fitting 36 when valve member 34 is in the axial position shown in FIG. 2.) This threshold value is determined by relief valve 46 and is preferably set just below the relief pressure of the pump 14. As the backpressure in primary channel 35 approaches the predetermined control pressure, this pressure increase causes relief valve 46 to open allowing fluid flow through orifice 38, secondary volume 44, Port D, fluid line 45*a*, Port E, relief valve 46, Port F, and fluid line 45*b*. This fluid flow is returned to reservoir 16 through fluid line 27 and is a relatively small portion of the total fluid flow generated by pump 14. When relief valve 46 opens and allows this fluid flow to occur, the fluid will experience a pressure drop as it flows through orifice 38.

Orifice 38 has a small cross-sectional area relative to valve sections 47, 49 and fluid flowing through orifice 38 experiences an increase in velocity within orifice 38 followed by a decrease in velocity in valve section 49 which is accompanied by a reduction in the pressure of the fluid. This use of an orifice having a relatively small cross-sectional area to reduce the pressure of hydraulic fluid actively flowing therethrough is well-known to those having ordinary skill in the art. Consequently, the fluid in secondary volume 44 will be at a lower pressure than the fluid in primary channel 35. This drop in pressure in secondary volume 44 creates a pressure differential between the secondary volume 44 and primary flow channel 35 which allows the higher pressure fluid in primary channel 35 to overcome the biasing force of spring 42 and push valve member 34 rearwards from the first axial position shown in FIG. 2 to the second axial position shown in FIG. 3. In the second axial position shown in FIG. 3, valve member 34 is spaced from open end 53 of tubular portion 51 and has moved axially to expose bypass Port C to the main flow of fluid from pump 14 coming in through port A. The flow from the pump 14 in through port A will thus be fed to both Port B and Port C with a significant majority of the flow being delivered directly to the steering assist device 24 through port C, bypassing the brake assist device 22. The flow control valve member 34 in combination with relief valve 46 thus operates to automatically meter excess oil flow through bypass Port C to prevent the line pressure to the brake assist device 22 from rising above the preset threshold pressure (i.e., the pressure at which pressure relief valve 46 is opened) which is preferably set just under the relief pressure of the pump 14.

When the backpressure generated by brake assist device 22 falls to the point at which relief valve 46 once again closes, the fluid flow through orifice 38 will be cut off and the fluid pressure in rear volume 44 will equalize to the fluid pressure in primary channel 35. As a result, spring 42 will once again bias valve member 34 forward and thereby cut off the fluid flow through Port C and return priority valve 20 to the normal flow condition illustrated in FIG. 2.

It is noted that while valve chamber 32 is shown as a blind bore, valve chamber 32 may be a through bore in alternative embodiments. For example, the end of chamber 32 engaged with spring 42 could be a formed by a threaded plug which is axially adjustable whereby the force exerted by spring 42 could be adjusted by rotating the threaded plug and adjusting its axial position with valve bore 32.

In FIGS. 2 and 3, relief valve 46 is shown as an adjustable relief valve, however, in alternative embodiments of the present invention relief valve 46 may be non-adjustable or utilize alternative forms of an adjustable relief valve. Relief valve 46 is shown in a more schematic form in FIG. 3 than in FIG. 2.

FIG. 2 illustrates the structure of one embodiment of relief valve 46. In the illustrated embodiment, valve 46 includes a ball valve member 48 which is biased into a closed position by a biasing member 50 taking the form of a helical spring. In FIG. 2, valve member 48 is in a first position wherein it closes valve 46 and prevents fluid flow therethrough while in FIG. 3, valve member 48 has been biased away from its valve seat into a second open position which permits the flow of fluid through valve 46. Spring 50 is operably coupled with threaded plug 52 with spring 50 engaging plug 52 on its end opposite ball 48 and biases ball 48 towards its first or closed position shown in FIG. 2. Plug 52 has helical threads 62 engaged with cooperating threads on the body of valve 46. By adjusting the position of plug 52, the biasing force exerted by spring 50 on ball 48, and consequently, the fluid pressure required to open valve 46 can be externally adjusted thereby permitting the external adjustment of the control pressure at which fluid flow bypasses brake assist device 22. In other words, valve 46 defines a selectively variable resistance to the opening of valve 46 which is determined by the differential between the fluid pressure at ports E (inlet port of valve 46) and F (discharge port of valve 46) and the biasing force of spring 50. By repositioning threaded plug 52, the biasing force exerted by spring 50 is adjusted and, consequently, the resistance to the opening of valve 46 and the threshold pressure at which valve 20 diverts fluid through bypass port C is also adjusted.

As evident from the description presented above, hydraulic circuit 10 includes, in series arrangement and in serial order, hydraulic pump 14, valve 20, brake booster device 22, steering gear device 24 and reservoir 16. When valve 20 is not diverting a portion of the fluid flow through port C to bypass brake booster 22 as occurs when brake booster 22 is generating a relatively high back pressure, a substantial majority of the fluid flow discharged from pump 14 will flow along primary flow path 1 I that extends from the outlet of pump 14, through discharge line 18, through valve 20 from port A to port B along primary flow channel 35, through hydraulic line 19 to brake booster 22, through hydraulic line 25 to steering gear 24, through hydraulic line 27 to reservoir 16 and then to the inlet of pump 14 wherein the cycle is repeated. As described above, when the pressure upstream of brake booster 22 is elevated to a threshold value, valve 46 will open resulting in the exposure of bypass port C whereby valve 20 will split the fluid flow with a portion being communicated to port B in the primary flow path upstream of brake booster 22 and another portion of the fluid flow being diverted through bypass port C to hydraulic line 21 which communicates the fluid to a point in the primary flow path downstream of brake booster 22 and upstream of steering gear device 24.

While the present invention has been described above with reference to a hydraulic system that combines both a steering gear assist device and a brake assist device, it may also be employed with other hydraulic devices and systems. For example, it is known to employ a single hydraulic fluid pump to power the fluid motor of a steering assist device and a second fluid motor associated with a radiator cooling fan. U.S. Pat. No. 5,802,848, for example, discloses a system having a steering gear assist device and a radiator cooling fan with a fluid motor powered by a single hydraulic fluid pump and is incorporated herein by reference. In alternative embodiments of the present invention, the priority valve and relief valve arrangement disclosed herein could be employed to facilitate the use of a single hydraulic fluid pump to power the fluid motors of both a steering gear assist device and that of a radiator cooling fan.

Furthermore, the priority valve and relief valve arrangement of the present system could be used to control the fluid flow associated with two hydraulic devices (e.g., a brake assist device, a steering gear assist device, a radiator fan having a fluid motor, or other hydraulic device), or two hydraulic circuits, wherein the priority valve and relief valve arrangement and the two associated hydraulic devices or circuits, form one portion of a larger complex hydraulic circuit.

While this invention has been described as having an exemplary design, the present invention may be further modified within the spirit and scope of this disclosure. This application is therefore intended to cover any variations, uses, or adaptations of the invention using its general principles.

What is claimed is:

1. A vehicular hydraulic system comprising:

a hydraulic circuit having, arranged in series and in serial order along a primary flow path, a hydraulic pump, a first hydraulic application, and a second hydraulic application;

wherein said hydraulic circuit further includes a flow-splitting valve having a valve body and a valve member, said valve body defining a valve chamber, said valve chamber defining an axis wherein said valve member is axially slidable within said chamber between a first axial position and a second axial position and partitions said chamber into a primary flow channel and a secondary volume, said valve member having a first end that faces said primary flow channel and a second end located in said secondary volume and further defining a pressure-reducing orifice located in said first end and providing fluid communication between said primary flow channel and said secondary volume; said valve body further defining an inlet port in fluid communication with said primary flow channel, an outlet port in fluid communication with said primary flow channel, a secondary volume port in fluid communication with said secondary volume, and a bypass port, said bypass port being disposed at an axially intermediate position with said secondary volume port being disposed on one axial side of said bypass port and said inlet port and said outlet port being disposed on the opposing axial side of said bypass port, said bypass port being sealed from fluid communication with said valve chamber when said valve member is in said first axial position and said bypass port being in fluid communication with said primary flow channel when said valve member is in said second axial position, said flow-splitting valve operably disposed in said hydraulic circuit downstream of said pump and upstream of said first hydraulic application wherein said primary flow path extends from said hydraulic pump to said inlet port, through said primary flow channel and said outlet port to said first hydraulic application; said bypass port being in fluid communication with said primary flow path at a point downstream of said first hydraulic application and upstream of said second hydraulic application;

a biasing member operably coupled with said valve member and biasing said valve member toward said first position; and a one-way relief valve operably disposed in said hydraulic circuit between said secondary volume port and said primary flow path at a location downstream of said second hydraulic application and upstream of said pump; said relief valve allowing fluid flow from said secondary volume port to said primary flow path when a pressure in said primary flow channel communicated to said secondary volume through said pressure-reducing orifice exceeds a threshold pressure value and wherein, when said relief valve permits fluid flow therethrough, fluid flowing from said primary flow channel to said secondary volume through said pressure-reducing orifice experiences a reduction in pressure thereby producing a pressure differential between said secondary volume and said primary flow channel, said pressure differential biasing said valve member from said first axial position to said second axial position; and wherein, when said relief valve closes and terminates fluid flow therethrough, said pressure differential decreases and said biasing member biases said valve member to said first axial position, and wherein said relief valve defines a selectively variable resistance to opening of said relief valve to fluid flow therethrough whereby said threshold pressure value is adjustable.

2. The vehicular hydraulic system of claim 1 wherein external adjustment of said relief valve selectively varies said resistance.

3. The vehicular hydraulic system of claim 1 wherein said one-way relief valve comprises:

a second valve member operably disposed within said relief valve and moveable between a first position wherein said second valve member prevents fluid flow through said relief valve and a second position wherein said second valve member allows fluid flow through said relief valve;

a second biasing member biasing said second valve member towards said first position; and a threaded member operably coupled with said biasing member, said threaded member being externally repositionable wherein repositioning of said threaded member varies said threshold value.

4. The vehicular hydraulic system of claim 1 further comprising a hydraulic reservoir operably disposed in said hydraulic circuit downstream of said second hydraulic application and upstream of said pump and wherein a fluid pressure within said reservoir is communicated to a discharge port of said relief valve.

5. The vehicular hydraulic system of claim 1 wherein said first hydraulic application is a hydraulic brake booster device.

6. The vehicular hydraulic system of claim 1 wherein said second hydraulic application is a hydraulic steering gear device.

7. A vehicular hydraulic system comprising:

a hydraulic circuit having, arranged in series and in serial order along a primary flow path, a hydraulic pump, a first hydraulic application, and a second hydraulic application;

wherein said hydraulic circuit further includes a flow-splitting valve having a valve body and a valve member, said valve body defining a valve chamber, said valve chamber defining an axis wherein said valve member is axially slidable within said chamber between a first axial position and a second axial position and partitions said chamber into a primary flow channel and a secondary volume, said valve member having a first end that faces said primary flow channel and a second end located in said secondary volume and further defining a pressure-reducing orifice located in said first end and providing fluid communication between said primary flow channel and said secondary volume; said valve body further defining an inlet port in fluid communication with said primary flow channel, an outlet port in fluid communication with said primary flow channel, a secondary volume port in fluid communication with said secondary volume, and a bypass port, said bypass port being disposed at an axially intermediate position with said secondary volume port being disposed on one axial side of said bypass port and said inlet port and said outlet port being disposed on the opposing axial side of said bypass port, said bypass port being sealed from fluid communication with said valve chamber when said valve member is in said first axial position and said bypass port being in fluid communication with said primary flow channel when said valve member is in said second axial position, said flow-splitting valve operably disposed in said hydraulic circuit downstream of said pump and upstream of said first hydraulic application wherein said primary flow path extends from said hydraulic pump to said inlet port, through said primary flow channel and said outlet port to said first hydraulic application; said bypass port being in fluid communication with said primary flow path at a point downstream of said first hydraulic application and upstream of said second hydraulic application;

a biasing member operably coupled with said valve member and biasing said valve member toward said first position; and a one-way relief valve operably disposed in a fluid line extending from said secondary volume port to said primary flow path at a location downstream of said second hydraulic application and upstream of said pump; said relief valve being spaced from said flow-splitting valve by a portion of said fluid line; said relief valve allowing fluid flow from said secondary volume port to said primary flow path when a pressure in said primary flow channel communicated to said secondary volume through said pressure-reducing orifice exceeds a threshold pressure and wherein, when said relief valve permits fluid flow therethrough, fluid flowing from said primary flow channel to said secondary volume through said pressure-reducing orifice experiences a reduction in pressure thereby producing a pressure differential between said secondary volume and said primary flow channel, said pressure differential biasing said valve member from said first axial position to said second axial position; and wherein, when said relief valve closes and terminates fluid flow therethrough, said pressure differential decreases and said biasing member biases said valve member to said first axial position.

8. The vehicular hydraulic system of claim 7 wherein said relief valve defines a selectively variable resistance to opening of said relief valve to fluid flow therethrough whereby said threshold pressure value is adjustable.

9. The vehicular hydraulic system of claim 7 wherein said one-way relief valve comprises:

a second valve member operably disposed within said relief valve and moveable between a first position wherein said second valve member prevents fluid flow through said relief valve and a second position wherein said second valve member allows fluid flow through said relief valve;

a second biasing member biasing said second valve member towards said first position; and a threaded member operably coupled with said biasing member, said threaded member being externally repositionable wherein repositioning of said threaded member varies said threshold value.

10. The vehicular hydraulic system of claim 7 further comprising a hydraulic reservoir operably disposed in said hydraulic circuit downstream of said second hydraulic application and upstream of said pump and wherein a fluid pressure within said reservoir is communicated to a discharge port of said relief valve.

11. The vehicular hydraulic system of claim 7 wherein said first hydraulic application is a hydraulic brake booster device.

12. The vehicular hydraulic system of claim 7 wherein said second hydraulic application is a hydraulic steering gear device.

13. The vehicular hydraulic system of claim 7 wherein said first hydraulic application is a hydraulic brake booster device and said second hydraulic application is a hydraulic steering gear device.

14. A vehicular hydraulic system comprising:

a hydraulic circuit having, arranged in series and in serial order along a primary flow path, a hydraulic pump, a hydraulic brake booster device, and a hydraulic steering gear device;

wherein said hydraulic circuit further includes a flow-splitting valve having a valve body and a valve member, said valve body defining a valve chamber, said valve chamber defining an axis wherein said valve member is axially slidable within said chamber between a first axial position and a second axial position and partitions said chamber into a primary flow channel and a secondary volume, said valve member having a first end that faces said primary flow channel and a second end located in said secondary volume and further defining a pressure-reducing orifice located in said first end and providing fluid communication between said primary flow channel and said secondary volume; said valve body further defining an inlet port in fluid communication with said primary flow channel, an outlet port in fluid communication with said primary flow channel, a secondary volume port in fluid communication with said secondary volume, and a bypass port, said bypass port being disposed at an axially intermediate position with said secondary volume port being disposed on one axial side of said bypass port and said inlet port and said outlet port being disposed on the opposing axial side of said bypass port, said bypass port being sealed from fluid communication with said valve chamber when said valve member is in said first axial position and said bypass port being in fluid communication with said primary flow channel when said valve member is in said second axial position, said flow-splitting valve operably disposed in said hydraulic circuit downstream of said pump and upstream of said brake booster device wherein said primary flow path extends from said hydraulic pump to said inlet port, through said primary flow channel and said outlet port to said brake booster device; said bypass port being in fluid communication with said primary flow path at a point downstream of said brake booster device and upstream of said steering gear device;

a biasing member operably coupled with said valve member and biasing said valve member toward said first position; and a one-way relief valve operably disposed in said hydraulic circuit between said secondary volume port and said primary flow path at a location downstream of said steering gear device and upstream of said pump; said relief valve allowing fluid flow from said secondary volume port to said primary flow path when a pressure in said primary flow channel communicated to said secondary volume through said pressure-reducing orifice exceeds a threshold pressure value and wherein, when said relief valve permits fluid flow therethrough, fluid flowing from said primary flow channel to said secondary volume through said pressure-reducing orifice experiences a reduction in pressure thereby producing a pressure differential between said secondary volume and said primary flow channel, said pressure differential biasing said valve member from said first axial position to said second axial position; and wherein, when said relief valve closes and terminates fluid flow therethrough, said pressure differential decreases and said biasing member biases said valve member to said first axial position, and wherein said relief valve defines a selectively variable resistance to opening of said relief valve to fluid flow therethrough whereby said threshold pressure value is adjustable.

15. The vehicular hydraulic system of claim 14 wherein external adjustment of said relief valve selectively varies said resistance.

16. The vehicular hydraulic system of claim 14 wherein said one-way relief valve comprises:

a second valve member operably disposed within said relief valve and moveable between a first position wherein said second valve member prevents fluid flow through said relief valve and a second position wherein said second valve member allows fluid flow through said relief valve;

a second biasing member biasing said second valve member towards said first position; and a threaded member operably coupled with said biasing member, said threaded member being externally repositionable wherein repositioning of said threaded member varies said threshold value.

17. The vehicular hydraulic system of claim 14 further comprising a hydraulic reservoir operably disposed in said hydraulic circuit downstream of said second hydraulic application and upstream of said pump and wherein a fluid pressure within said reservoir is communicated to a discharge port of said relief valve.

* * * * *